US009661903B2

(12) United States Patent
Bisserier

(10) Patent No.: US 9,661,903 B2
(45) Date of Patent: May 30, 2017

(54) CROSS BOW RING WITH ORNAMENT SUPPORT

(71) Applicant: Claude Bisserier, Oak Park, CA (US)

(72) Inventor: Claude Bisserier, Oak Park, CA (US)

( * ) Notice: Subject to any disclaimer, the term of this patent is extended or adjusted under 35 U.S.C. 154(b) by 299 days.

(21) Appl. No.: 14/418,883

(22) PCT Filed: Mar. 14, 2013

(86) PCT No.: PCT/US2013/031628
§ 371 (c)(1),
(2) Date: Jan. 30, 2015

(87) PCT Pub. No.: WO2014/035476
PCT Pub. Date: Mar. 6, 2014

(65) Prior Publication Data

US 2015/0265009 A1 Sep. 24, 2015

Related U.S. Application Data

(60) Provisional application No. 61/694,706, filed on Aug. 29, 2012.

(51) Int. Cl.
*A44C 9/00* (2006.01)

(52) U.S. Cl.
CPC ..... *A44C 9/0015* (2013.01); *A44C 9/0007* (2013.01)

(58) Field of Classification Search
CPC ... A44C 9/0007; A44C 9/0015; A44C 9/0023; A44C 9/003; A44C 15/001; A44C 15/00
USPC ..... 63/15, 15.1; D11/3, 12, 26
See application file for complete search history.

(56) References Cited

U.S. PATENT DOCUMENTS 5,353,608 A * 10/1994 Berkowitz ..... A44C 15/001 63/1.17
2001/0020369 A1 9/2001 Hirano
2004/0177647 A1 9/2004 Dennis
2005/0044889 A1 3/2005 Baum et al.
2008/0302134 A1* 12/2008 De Lyrot ..... A44C 9/0015 63/15.7

(Continued)

FOREIGN PATENT DOCUMENTS

JP 06292608 10/1994
JP 2000125912 5/2000

(Continued)

OTHER PUBLICATIONS

International Search Report and Written Opinion for serial No. PCT/US2013/031628 mailed Jun. 26, 2014.

*Primary Examiner* — Jack W Lavinder
(74) *Attorney, Agent, or Firm* — Brooks Acordia IP Law, P.C.; Pejman Yedidsion; Christopher Weiss

(57) ABSTRACT

Articles of jewelry comprising an ornamental support structure (100), a first aperture (108), a second aperture (110), a first annular element (104) received by the ornamental support structure (100) through the first aperture (108), and a second annular element (106) received by the ornamental support structure (100) through the second aperture (110). The first aperture (108) and the second aperture (110) may be shaped to limit lateral movement of the respective received annular elements (104, 106) while allowing the annular elements (104, 106) to rotate relative to the ornamental support structure. The first annular element (104) may be entwined with the second annular element (106).

7 Claims, 4 Drawing Sheets

(56) References Cited

U.S. PATENT DOCUMENTS

2012/0198887 A1 8/2012 Bisserier

FOREIGN PATENT DOCUMENTS

| | | | |
|---|---|---|---|
| JP | 2000-236921 | A | 9/2000 |
| JP | 2008178430 | | 8/2008 |
| JP | 3151504 | | 6/2009 |
| JP | 2009148517 | | 7/2009 |
| KR | 20-1991-0001319 | | 2/1991 |
| WO | 2011075533 | A2 | 6/2011 |

* cited by examiner

CROSS BOW RING WITH ORNAMENT SUPPORT

CROSS-REFERENCE TO RELATED APPLICATIONS

This application is a 371 of International Application No. PCT/US2013/031628, filed Mar. 14, 2013, which claims priority to and the benefit of Provisional Patent Application No. 61/694,706 filed Aug. 29, 2012 the contents of which are hereby incorporated by reference herein for all purposes.

TECHNICAL FIELD

The present invention relates generally to jewelry ring assemblies and particularly to entwined annular elements.

SUMMARY

Exemplary article of jewelry embodiments may comprise an ornamental support structure; a first aperture disposed within a bottom portion of the ornamental support structure; a second aperture disposed within a bottom portion of the ornamental support structure; a first annular element received by the ornamental support structure through the first aperture; and a second annular element received by the ornamental support structure through the second aperture; where the first aperture may be shaped to limit lateral movement of the received first annular element while allowing the first annular element to rotate relative to the ornamental support structure, the second aperture may be shaped to limit lateral movement of the received second annular element while allowing the second annular element to rotate relative to the ornamental support structure, and the first annular element may be entwined with the second annular element. In additional exemplary article of jewelry embodiments the first annular element and the second annular element may further comprise at least one of: a precious stone, a synthetic material, acrylic, and crystal. In additional exemplary article of jewelry embodiments at least part of a surface of the first annular element and the second annular element may be at least one of: textured and smooth. In additional exemplary article of jewelry embodiments the ornamental support structure may further comprise an upper ornamental support structure; and a lower ornamental support structure, where the first aperture and the second aperture may be located within the lower ornament support structure. In additional exemplary article of jewelry embodiments the upper ornamental support structure may further comprise a first offset ornament support structure; a second offset ornament support structure; and a collar configured to support an ornament; where the collar may be disposed between the first offset ornament support structure and the second offset ornament support structure. Additional exemplary article of jewelry embodiments may further comprise at least one ornament on at least one of: a top portion of the first offset support structure and a top portion of the second offset support structure. In additional exemplary article of jewelry embodiments the upper ornamental support structure may further comprise at least one ornament support configured to support an ornament, and where the supported ornament may partially extend into the lower ornamental support structure.

Additional exemplary article of jewelry embodiments may comprise an ornamental support structure; a first aperture disposed within a bottom portion of the ornamental support structure; a second aperture disposed within a bottom portion of the ornamental support structure; a first annular element received by the ornamental support structure through the first aperture; and a second annular element received by the ornamental support structure through the second aperture; where the first aperture may be shaped to limit lateral movement of the received first annular element while allowing the first annular element to rotate relative to the ornamental support structure, the second aperture may be shaped to limit lateral movement of the received second annular element while allowing the second annular element to rotate relative to the ornamental support structure, and the first annular element may be substantially parallel with the second annular element. In additional exemplary article of jewelry embodiments the first annular element and the second annular element may further comprise at least one of: a precious stone, a synthetic material, acrylic, and crystal. In additional exemplary article of jewelry embodiments at least part of a surface of the first annular element and the second annular element may be at least one of: textured and smooth. In additional exemplary article of jewelry embodiments the ornamental support structure may further comprise an upper ornamental support structure; and a lower ornamental support structure, where the first aperture and the second aperture may be located within the lower ornament support structure. In additional exemplary article of jewelry embodiments the upper ornamental support structure further comprises: a first offset ornament support structure; a second offset ornament support structure; and a collar configured to support an ornament; where the collar may be disposed between the first offset ornament support structure and the second offset ornament support structure. Additional exemplary article of jewelry embodiments may further comprise at least one ornament on at least one of: a top portion of the first offset support structure and a top portion of the second offset support structure. In additional exemplary article of jewelry embodiments the upper ornamental support structure may further comprise at least one ornament support configured to support an ornament, and where the supported ornament may partially extend into the lower ornamental support structure.

BRIEF DESCRIPTION OF DRAWINGS

Embodiments are illustrated by way of example and not limitation in the figures of the accompanying drawings, and in which.

DETAILED DESCRIPTION

Figure 1A:
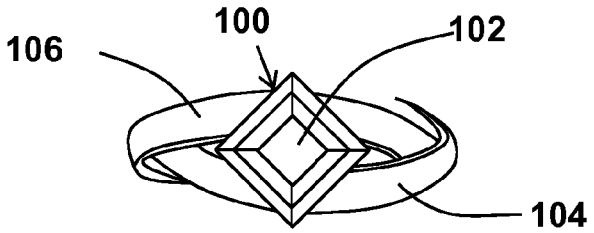
FIG. 1A depicts a top view of an ornament support structure.

FIG. 1A depicts a top view of an ornament support structure 100. The ornament support structure 100 may comprise a center ornament 102, e.g., a stone, gemstone, pearl, etc. The ornament support structure 100 is engaged to, detachably attached to, and/or received by a first annular element 104 and a second annular element 106. The annular elements may, for example, comprise precious stones, synthetic materials, acrylic, crystal, or other materials.

Figure 1B:
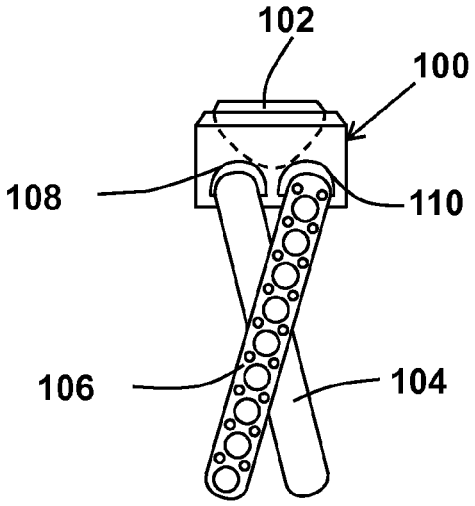
FIG. 1B depicts a side view of an ornament support structure.

FIG. 1B depicts a side view of an ornament support structure 100. The ornament support structure 100 may comprise a center ornament 102, e.g., a stone, gemstone, pearl, etc. The ornament support structure 100 may comprise a first aperture 108 to engage or receive a first annular element 104 and a second aperture 110 to engage or receive a second annular element 106. The first aperture 108 and the second aperture 110 may be any shape, e.g., rectangular, and may be shaped so as to limit lateral movement of the first annular element 104 and the second annular element 106 while permitting rotation of the first annular element 104 and the second annular element 106 through the first aperture 108 and the second aperture 110, respectively. In some embodiments, the shape of the first aperture 108 and the shape of the second aperture 110 may follow the contour of at least one surface of the first annular element 104 and the second annular element 106, respectively, such that the shape of each aperture 108,110 is shaped so as to limit lateral movement of each respective annular element 104,106 with regard to the ornament support structure 100. Depending on the shape of the annular elements 104,106, at least part of the respective apertures 108,110 may be shaped so as to limit lateral movement of the annular elements 104,106 while allowing rotation of the annular elements 104,106 with respect to the ornament support structure 100. In this exemplary embodiment, the first annular element 104 and the second annular element 106 may be entwined. In some embodiments, one or more ornaments may be disposed on the surface of the first annular element 104, on the surface of the second annular element 106, or on the surface of both annular elements 104,106. In other embodiments, at least a portion of the surface of the first annular element 104, the second annular element 106, or both, may be textured, smooth, hold one or more stones, and comprise two or more different materials.

Figure 1C:
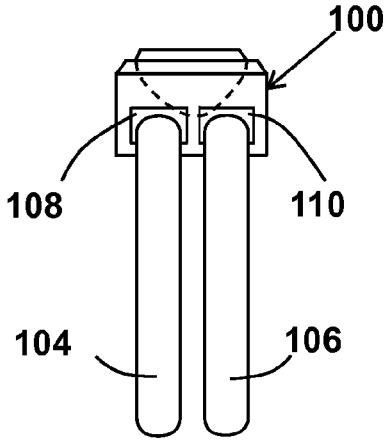
FIG. 1C depicts a side view of an ornament support structure.

FIG. 1C depicts a side view of an ornament support structure 100. In this exemplary embodiment, the first annular element 104 and the second annular element 106 may be parallel to each other, such that a slight variation in the position of the first annular element 104 relative to the second annular element 106 may occur due to manufacturing tolerances and/or one or more forces applied to one or two of the annular elements 104,106. The first annular element 104, the second annular element 106, or both, may be free to rotate through the first aperture 108 and the second aperture 110, respectively.

Figure 1D:
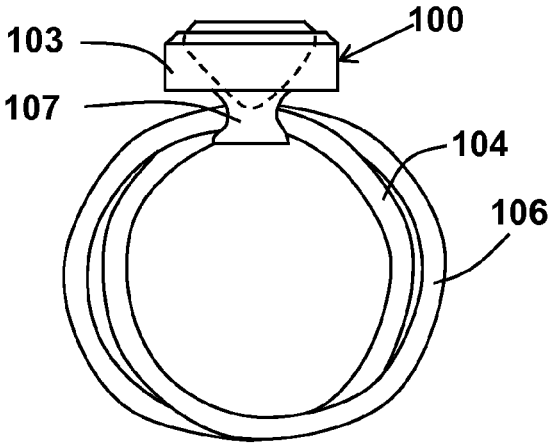
FIG. 1D depicts a front view of an ornament support structure.

FIG. 1D depicts a front view of an ornament support structure 100. In this exemplary embodiment, the first annular element 104 and the second annular element 106 are entwined. The annular elements 104,106 may be engaged to or received by the ornament support structure 100 via their respective apertures (see FIG. 1B). The ornament support structure may comprise an upper ornament support structure 103 and a lower ornament support structure 107. The center ornament, depicted via dashed lines, may extend from the top of the upper ornament support structure 103 down into the lower ornament support structure 107. The apertures 108,110 (see FIG. 1B) may engage their respective annular elements 104,106 at the lower ornament support structure 107.

Figure 2A:
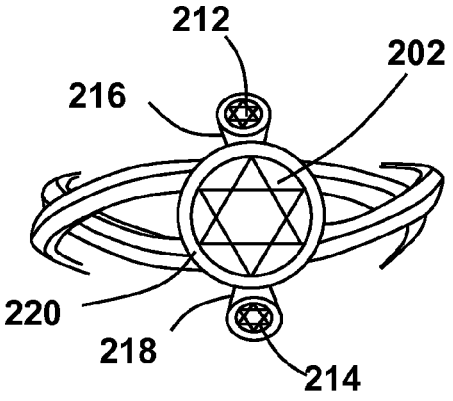
FIG. 2A depicts a top view of an exemplary ring structure embodiment.

FIG. 2A depicts a top view of an exemplary embodiment of the cross bow ring with ornament support. This exemplary embodiment may comprise a first offset ornament support structure 216 and a second offset ornament support structure 218 that may display a first offset ornament 212 and a second offset ornament 214, respectively. The offset ornaments 212,214 may be the same material as a center ornament 202, e.g., a stone, or may be made of different materials. Optionally, the center ornament 202 may be supported by a collar 220.

Figure 2B:
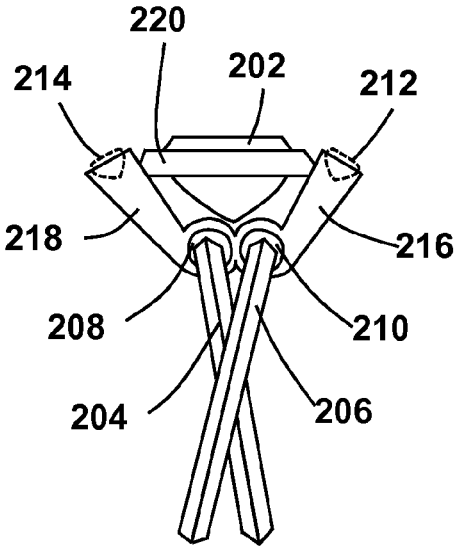
FIG. 2B depicts a side view of an exemplary ring structure embodiment.

FIG. 2B depicts a side view of an exemplary embodiment of the cross bow ring with ornament support. This exemplary embodiment may comprise a collar 220 to support the center ornament 202. The collar 220 may be supported on two or more opposing sides, for example, by a first ornament support structure 216 and a second ornament support structure 218. The ornament support structures 216,218 may display one or more offset ornaments 212,214 on a top portion. The ornament support structures 216,218 may be connected at a bottom portion and include openings for a first aperture 208 and a second aperture 210 to engage a first annular element 204 and a second annular element 206, respectively. In this exemplary embodiment, the apertures 208,210 may be round to accommodate a circular or substantially square cross section of the annular elements 204, 206.

Figure 3A:
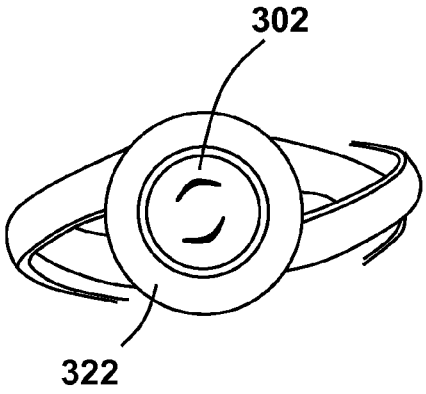
FIG. 3A depicts a top view of an exemplary ring structure embodiment.
Figure 3B:
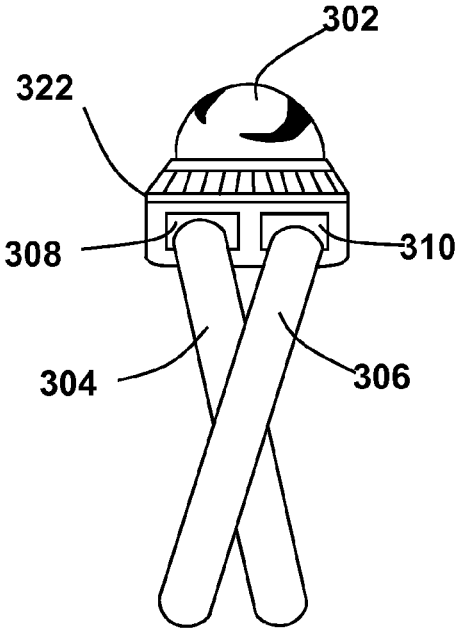
FIG. 3B depicts a side view of an exemplary ring structure embodiment.

FIG. 3A depicts a top view of an exemplary embodiment of the cross bow ring with ornament support. In this embodiment, the ornament support structure 322 may have an integrated top and bottom portion. FIG. 3B depicts a side view of an exemplary embodiment. In this embodiment, the center ornament 302 may have a spherical shape that may either extend into the ornament support structure 322 or be substantially hemispherical in shape. The surface of the center ornament 302 may be smooth or textured, and may have a design. The cross bow ring with ornament support may comprise a first aperture 308 to engage or receive a first annular element 304 and a second aperture 310 to engage or receive a second annular element 306. The first aperture 308 and the second aperture 310 may be any shape, e.g., rectangular, and may be shaped so as to limit lateral movement of the first annular element 304 and the second annular element 306 while permitting rotation of the first annular element 304 and the second annular element 306 through the first aperture 308 and the second aperture 310, respectively.

Figure 4A:
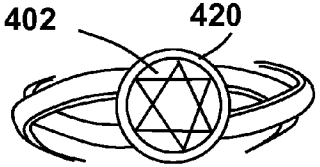
FIG. 4A depicts a top view of an exemplary ring structure embodiment.
Figure 4B:
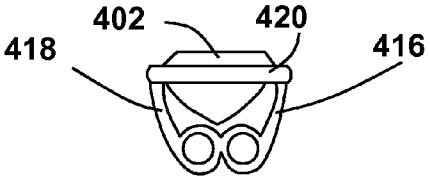
FIG. 4B depicts a side view of an exemplary ring structure embodiment.
Figure 4C:
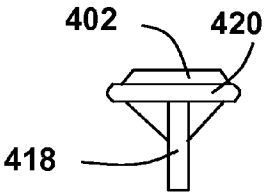
FIG. 4C depicts a front view of an exemplary ring structure embodiment.

FIG. 4A depicts a top view of an exemplary embodiment of the cross bow ring with ornament support. FIG. 4B depicts a side view of an exemplary embodiment. FIG. 4C depicts a front view of an exemplary embodiment. This exemplary embodiment may comprise a first ornament support structure 416 and a second ornament support structure 418 connected to a collar 420 that may support a center ornament 402. Additionally, in this embodiment, the ornament support structures 416,418 may be designed so as to allow for a less obstructed view of the center ornament 402 in a side viewing orientation.

Figure 5A:
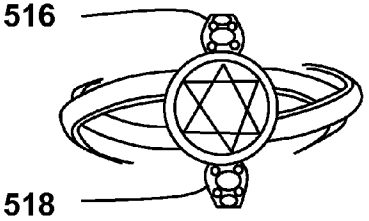
FIG. 5A depicts a top view of an exemplary ring structure embodiment.
Figure 5B:
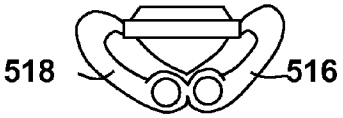
FIG. 5B depicts a side view of an exemplary ring structure embodiment.
Figure 5C:
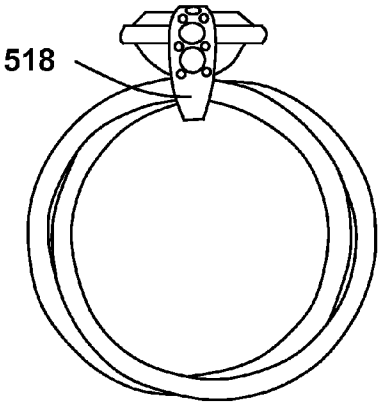
FIG. 5C depicts a front view of an exemplary ring structure embodiment.

FIG. 5A depicts a top view of an exemplary embodiment of the cross bow ring with ornament support. FIG. 5B depicts a side view of an exemplary embodiment. FIG. 5C depicts a front view of an exemplary embodiment. In this embodiment, the first ornament support structure 516 and the second ornament support structure 518 may have one or more stones mounted on their respective surfaces.

Figure 6A:
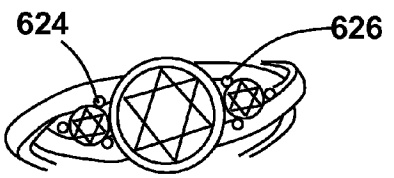
FIG. 6A depicts a top view of an exemplary ring structure embodiment.
Figure 6B:
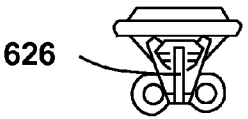
FIG. 6B depicts a side view of an exemplary ring structure embodiment.
Figure 6C:
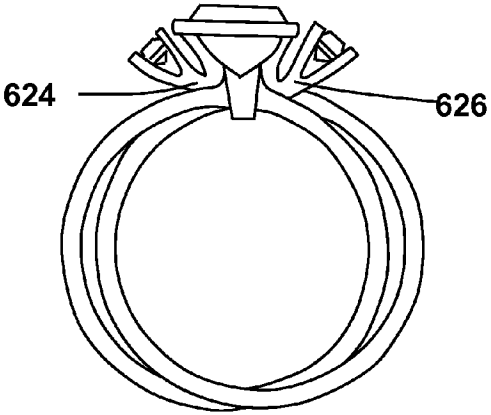
FIG. 6C depicts a front view of an exemplary ring structure embodiment.

FIG. 6A depicts a top view of an exemplary embodiment of the cross bow ring with ornament support. FIG. 6B depicts a side view of an exemplary embodiment of the cross bow ring with ornament support. FIG. 6C depicts a front view of an exemplary embodiment of the cross bow ring with ornament support. One exemplary embodiment may comprise a first additional ornament support structure 624 and a second additional ornament support structure 626 to display additional ornaments, e.g., stones. In some embodiments, these additional ornament support structures 624,626 may be of a three-prong design.

Figure 7A:
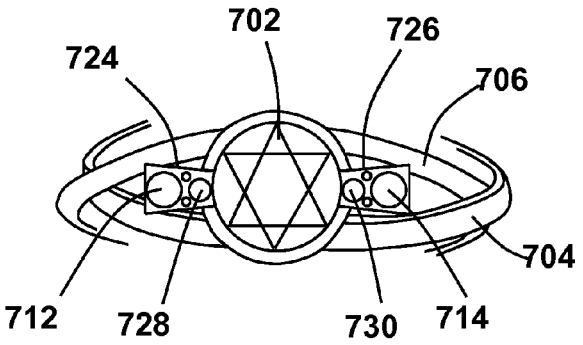
FIG. 7A depicts a top view of an exemplary ring structure embodiment.
Figure 7B:
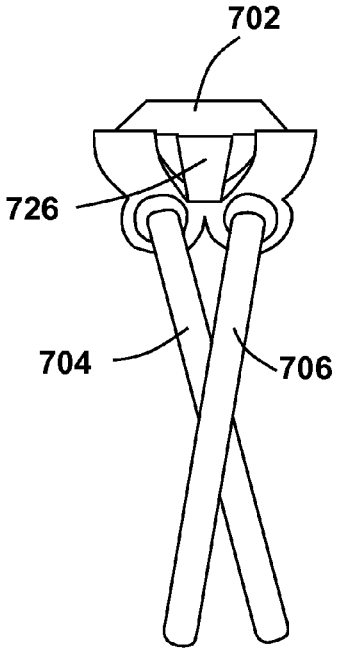
FIG. 7B depicts a side view of an exemplary ring structure embodiment.
Figure 7C:
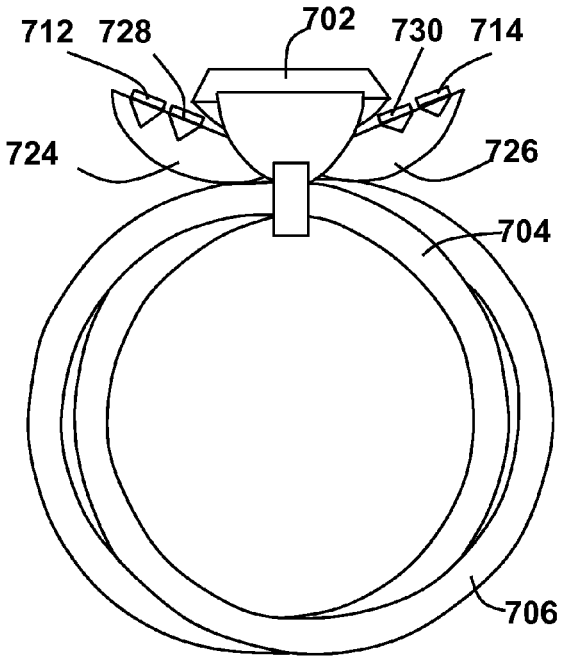
FIG. 7C depicts a front view of an exemplary ring structure embodiment.

FIG. 7A depicts a top view of an exemplary embodiment of the cross bow ring with ornament support. FIG. 7B depicts a side view of an exemplary embodiment of the cross bow ring with ornament support. FIG. 7C depicts a front view of an exemplary embodiment of the cross bow ring with ornament support. The exemplary cross bow ring with ornament support may comprise a center ornament 702, e.g., a stone, gemstone, pearl, etc. In this exemplary embodiment, the additional ornament support structures 724,726 may comprise additional ornaments 712,714,728,730. In some embodiments, the first annular element 704 and second annular element 706 may be plain, mounted with stones, and/or mounted with textured domes. In an exemplary embodiment, the cross-section of one or more of the annular elements 704,706 may be round, oval, square, trapezoidal, or triangular.

One of ordinary skill in the art will appreciate that the elements, components, steps, and functions described herein may be further subdivided, combined, and/or varied, and yet, still remain within the spirit of the embodiments of the invention. Accordingly, it should be understood that various features and aspects of the disclosed embodiments may be combined with, or substituted for one another in order to form varying modes of the invention, as disclosed by example. It is intended that the scope of the present invention herein disclosed by examples should not be limited by the particular disclosed embodiments described above. Accordingly, the invention has been disclosed by way of example and not limitation, and reference should be made to the following claims to determine the scope of the present invention.

What is claimed is:

1. An article of jewelry comprising:

an ornamental support structure;

a first aperture disposed within a bottom portion of the ornamental support structure;

a second aperture disposed within the bottom portion of the ornamental support structure;

a first annular element received by the ornamental support structure through the first aperture; and a second annular element received by the ornamental support structure through the second aperture;

wherein the first aperture is shaped to limit lateral movement of the received first annular element while allowing the first annular element to rotate and pass through the first aperture, the second aperture is shaped to limit lateral movement of the received second annular element while allowing the second annular element to rotate and pass through the second aperture, and the first annular element is intertwined about the second annular element.

2. The article of jewelry of claim 1 wherein the first annular element and the second annular element each comprise at least one of: a precious stone, a synthetic material, acrylic, and crystal.

3. The article of jewelry of claim 1 wherein at least part of a surface of the first annular element and at least part of a surface of the second annular element is at least one of: textured and smooth.

4. The article of jewelry of claim 1 wherein the ornamental support structure comprises:

an upper ornamental support structure; and a lower ornamental support structure;

wherein the first aperture and the second aperture are located within the lower ornament support structure.

5. The article of jewelry of claim 4 wherein the upper ornamental support structure further comprises:

a first offset ornament support structure;

a second offset ornament support structure; and a collar configured to support an ornament;

wherein the collar is disposed between the first offset ornament support structure and the second offset ornament support structure.

6. The article of jewelry of claim 5 further comprising at least one ornament on at least one of: a top portion of the first offset ornament support structure and a top portion of the second offset ornament support structure.

7. The article of jewelry of claim 4 wherein the upper ornamental support structure further comprises:

at least one ornament support configured to support an ornament, and wherein the supported ornament partially extends into the lower ornamental support structure.

* * * * *